US009943168B1

(12) United States Patent
Butler et al.

(10) Patent No.: US 9,943,168 B1
(45) Date of Patent: Apr. 17, 2018

(54) ERGONOMIC STADIUM SEAT

(71) Applicant: Back Seat Products, LLC, Killen, AL (US)

(72) Inventors: Aric Dewayne Butler, Killen, AL (US); William Christopher Cross, Rogersville, AL (US)

(73) Assignee: Back Seat Products, LLC, Killen, AL (US)

( * ) Notice: Subject to any disclaimer, the term of this patent is extended or adjusted under 35 U.S.C. 154(b) by 0 days.

(21) Appl. No.: 15/671,947

(22) Filed: Aug. 8, 2017

Related U.S. Application Data

(63) Continuation of application No. 15/437,212, filed on Feb. 20, 2017, now Pat. No. 9,737,145.

(51) Int. Cl.

| | |
|---|---|
| ***A47C 1/16*** | (2006.01) |
| ***A47C 4/08*** | (2006.01) |
| ***A47C 4/18*** | (2006.01) |
| ***A47C 7/18*** | (2006.01) |

(52) U.S. Cl.
CPC ..... *A47C 1/16* (2013.01); *A47C 4/08* (2013.01); *A47C 4/18* (2013.01); *A47C 7/18* (2013.01)

(58) Field of Classification Search
CPC .... A47C 1/16; A47C 4/06; A47C 4/08; A47C 4/18; A47C 4/32; A47C 4/42; A47C 7/16; A47C 7/18
USPC ..... 297/252, 273, 465, 276
See application file for complete search history.

(56) References Cited

U.S. PATENT DOCUMENTS 3,076,678 A * 2/1963 Griffin ..... A61G 5/08 280/11
5,568,933 A * 10/1996 Mizuno ..... A61G 5/08 280/250.1

* cited by examiner

*Primary Examiner* — Milton Nelson, Jr.
(74) *Attorney, Agent, or Firm* — Waller Lansden Dortch & Davis LLP; Matthew C. Cox

(57) ABSTRACT

A portable seating apparatus includes a frame having first and second sides. A seat is disposed between the first and second sides of the frame. The seat is suspended between the first and second sides of the frame by multiple tension members such as straps. A first arm rest and first base member are positioned on the first side of the frame, and a second arm rest and second base member are positioned on the second side of the frame. One or more straps extends downwardly from each arm rest to support the suspended seat. In some embodiments, the first and second sides are hinged such that the seating apparatus may be folded for transport and storage. An arm rest hinge is disposed on each arm rest, and a base member hinge is disposed on each base member in some embodiments.

20 Claims, 10 Drawing Sheets

ERGONOMIC STADIUM SEAT

CROSS-REFERENCES TO RELATED APPLICATIONS

This application is a continuation of U.S. patent application Ser. No. 15/437,212 filed Feb. 20, 2017 entitled ERGONOMIC STADIUM SEAT, of which is herein incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND

The present disclosure relates generally to seating devices and methods and more particularly to portable seats for use in stadiums.

Event spaces such as stadiums, coliseums, amphitheaters, gymnasiums and other venues often provide flat bench-style seating for visitors. Conventional bench seats typically include a flat surface on which a user sits. Such seats are often made of metal or wood and extend along seating rows so that multiple spectators may sit on a single flat surface in a side-by-side arrangement. These types of seats are often oriented in an stepped configuration between forward rows and back rows such that users sitting in a rear row are positioned slightly above users seated in forward rows so that all users can see. These types of bench seats usually lack a backrest, are generally uncomfortable, and may even be painful for users who have back or joint conditions. Additionally, bench seats of this type are generally not padded, so users are often forced to sit directly against hard wood or metal surface.

Various devices have been developed for users to carry to sporting and entertainment events to make sitting on flat bench-style seats more comfortable. For example, conventional foam stadium seats include a portable pad that a user may carry to an event and place on top of the flat bench-style seat. The user may then sit on the pad to provide comfort. Some portable stadium seats also include a padded back support on a frame to allow a user to lean back while sitting on the stadium seat. For example, U.S. Pat. No. 3,994,529 teaches a stadium seat having a seat portion with a folding back for placement on a flat bench seat in a stadium.

Conventional portable stadium seats generally include a flat seating area and a flat back rest. These types of devices may provide some relief for users as compared to sitting directly on the bench seat itself. However, for many users, conventional portable stadium seats remain uncomfortable.

What is needed then are improvements in devices and methods for portable seats for use in stadiums, coliseums, amphitheaters, gymnasiums and other venues that provide flat bench-style seating for visitors.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present disclosure is to provide a portable seating apparatus including a frame and a seat attached to the frame, wherein the seat is suspended from the frame by two or more straps.

Another aspect of the present disclosure is to provide a portable seating apparatus for use on a bench such as a stadium bench, the apparatus including a frame and a seat suspended from the frame, wherein the seat is suspended above the bench.

A further aspect of the present disclosure is to provide a portable seating apparatus for use on a bench such as a stadium bench, the apparatus including a seat suspended from a frame, wherein the frame is foldable to facilitate ease of transport and storage.

Yet another aspect of the present disclosure is to provide a portable seating apparatus for use on a bench such as a stadium bench, the apparatus including a seat suspended from a frame by two or more straps, wherein the lengths of the straps are adjustable so a user can raise or lower the height of the seat above the bench or incline the seat while suspended above the bench.

Numerous other objects, advantages and features of the present disclosure will be readily apparent to those of skill in the art upon a review of the following drawings and description of a preferred embodiment.

DETAILED DESCRIPTION

Figure 1:
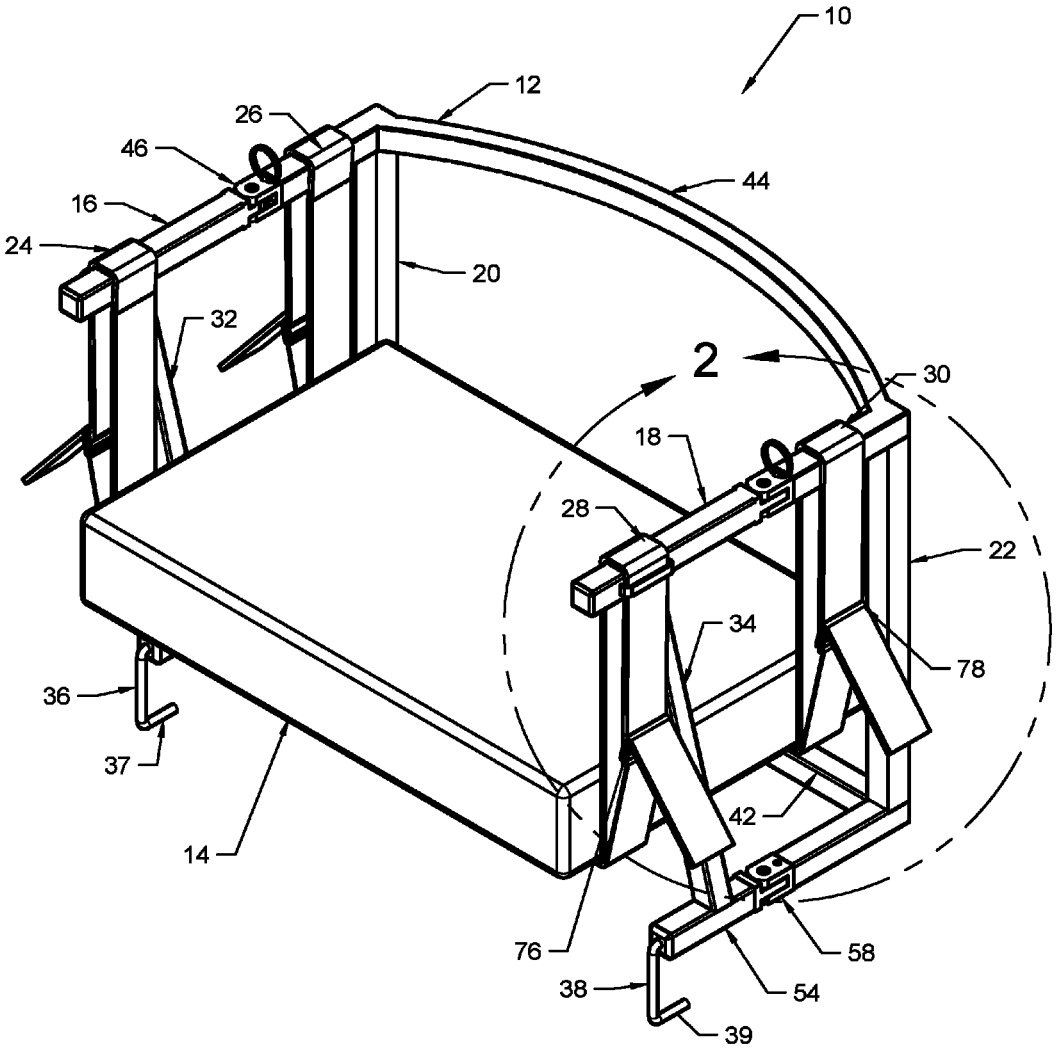
FIG. 1 is a perspective view of an embodiment of a portable seat apparatus in accordance with the present disclosure.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing, or as otherwise described. A person of skill in the art will recognize that the apparatus can assume different orientations when in use.

Referring to FIG. 1 an embodiment of an ergonomic stadium seat apparatus 10 is shown in a perspective view. Seat apparatus 10 includes a device that users may carry with them to a venue such as a stadium, gymnasium, auditorium or other environment where seating is provided using conventional flat bench-style seats. Seat apparatus 10 is generally configured to be positioned onto a conventional flat bench-style seat to provide improved stability, support and comfort. Seat apparatus 10 generally includes a frame 12 and a seat 14. Frame 12 may include any suitable rigid material such as but not limited to metal, plastic, wood or composite material. Frame 12 includes a first side generally having a first arm rest, a second side having a second arm rest opposite the first side, and one or more cross members spanning between the first and second sides. Seat 14 includes any suitable seat material such as a plastic, foam, wood, metal or other suitable material.

A feature of seat apparatus 10 is that seat 14 is suspended from frame 12 such that seat 14 does not rest directly against the bench surface of a stadium bench or other location where the seat apparatus 10 is placed. Instead, seat 14 is suspended by frame 12 such that seat 14 is elevated above the bench surface.

Seat apparatus 10 generally includes a first arm rest 16 and a second arm rest 18 positioned opposite the first arm rest 16. First arm rest 16 is attached to a first rear upright 20 extending upwardly from the seat area. Second arm rest 18 is attached to a second rear upright 22 extending upwardly from the seat area. First and second rear uprights 20, 22 are generally parallel to each other in some embodiments.

A feature of seat apparatus 10 in some embodiments includes one or more straps suspended from frame 12 to support seat 14. When seat 14 is supported by one or more straps in a hanging configuration, it may be possible to provide enhanced comfort to a user as opposed to conventional seating devices where the seat 14 lays flat against a hard surface. A first strap 24 extends down from first arm rest 16, and a second strap 28 extends down from second arm rest 18. First strap 24 is looped over and is supported by first arm rest 16, and second strap 28 is looped over and is supported by second arm rest 18 in some embodiments. First strap 24 may be referred to as first forward strap, and second strap 28 may be referred to as second forward strap. The lower end of first strap 24 is attached to seat 14 on one side, and the lower end of second strap 28 is attached to seat 14 at a location opposite the first strap 24. Each strap may be connected to seat 14 in various types of engagements, including stitching, using adhesives, using fasteners or other suitable fastening configurations. When a user sits on seat 14, the user's weight is partially supported by the first and second straps 24, 28 hanging between the first and second arm rests 16, 18 on frame 12.

Referring further to FIG. 1, a first rear strap 26 is positioned on first arm rest 16, and a second rear strap 30 is positioned on second arm rest 18 in some embodiments. First rear strap 26 is secured to seat 14 on the same edge as first forward strap 24, and second rear strap 30 is secured to seat 14 on the same edge as second forward strap 28. In such embodiments, seat 14 is suspended from four straps, with two straps hanging from first arm rest 16 and two straps hanging from second arm rest 18. Each strap may be formed of any suitable structure for hanging seat 14, including straps, cord, webbing, strings, rope, cables or other suitable tensile materials.

Figure 3:
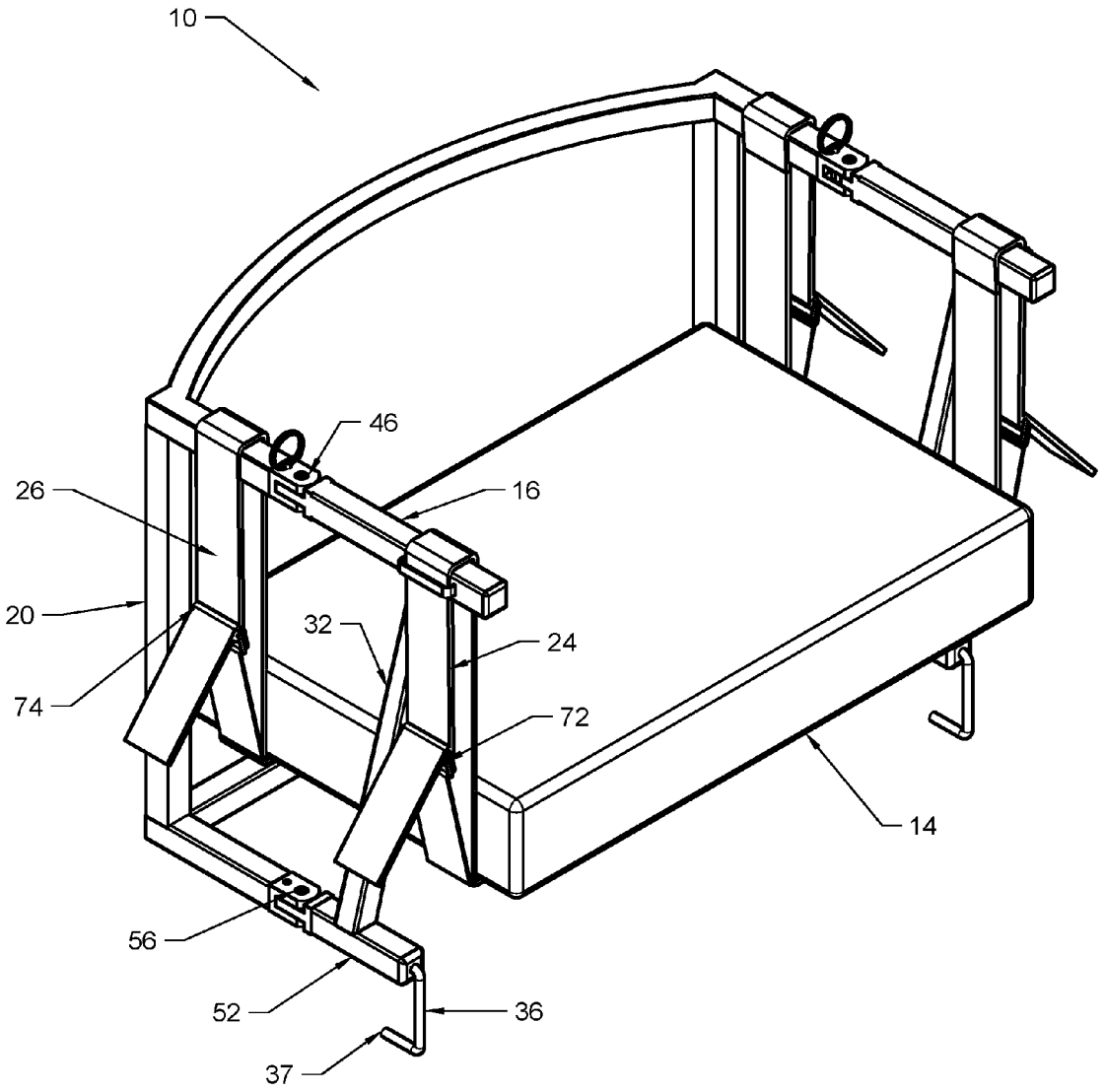
FIG. 3 is a perspective view of an embodiment of a portable seat apparatus in accordance with the present disclosure.

As shown in FIG. 1 and FIG. 3, frame 12 also includes a first base member 52 positioned on the same side of the device as first arm rest 16, and a second base member 54 positioned on the same side of the device as second arm rest 18. First and second base members 52, 54 provide substantially horizontal members positioned to rest against a flat bench seat or other surface upon which seat apparatus 10 is positioned. First base member 52 is oriented substantially perpendicular to first rear upright 20, and second base member 54 is oriented substantially perpendicular to second rear upright 22 in some embodiments.

Referring further to FIG. 1, a first forward upright 32 extends upwardly from first base member 52, and a second forward upright 34 extends upwardly from second base member 54. First forward upright 32 supports first arm rest 16 from below, and second forward upright 34 supports second arm rest 18 from below in some embodiments. First and second forward uprights 32, 34 provide additional support for first and second arm rests 16, 18 such that a user sitting on seat 14 suspended between first and second arm rests 16, 18 is adequately secured. In some embodiments, first arm rest 16 includes a first forward extension extending beyond the intersection with first forward upright 32, and second arm rest 18 includes a second forward extension extending beyond the intersection with second forward upright 34. In some embodiments, first strap 24 is positioned on the first forward extension, and second strap 28 is positioned on the second forward extension.

Referring further to FIG. 1, a lower cross member 42 spans between the first and second sides of the seat apparatus 10. Lower cross member 42 is a substantially horizontal member extending from first rear upright 20 to second rear upright 22. Lower cross member 42 may also be adjacent to first base member 52 at one end and also adjacent to second base member 54 at its opposite end.

Additionally, an upper cross member 44 spans between the first and second sides of the seat apparatus 10 above the lower cross member 42. Upper cross member 44 is positioned between first rear upright 20 and second rear upright 22. In some embodiments, upper cross member 44 is also adjacent to first arm rest 16 at one end and also adjacent to second arm rest 18 at its opposite end. Upper cross member 44 may operate as a backrest for users to lean back against when seated on seat 14 in some embodiments. Upper cross member 44 includes a concave curve shape in some embodiments to better facilitate usage as a backrest.

Figure 7:
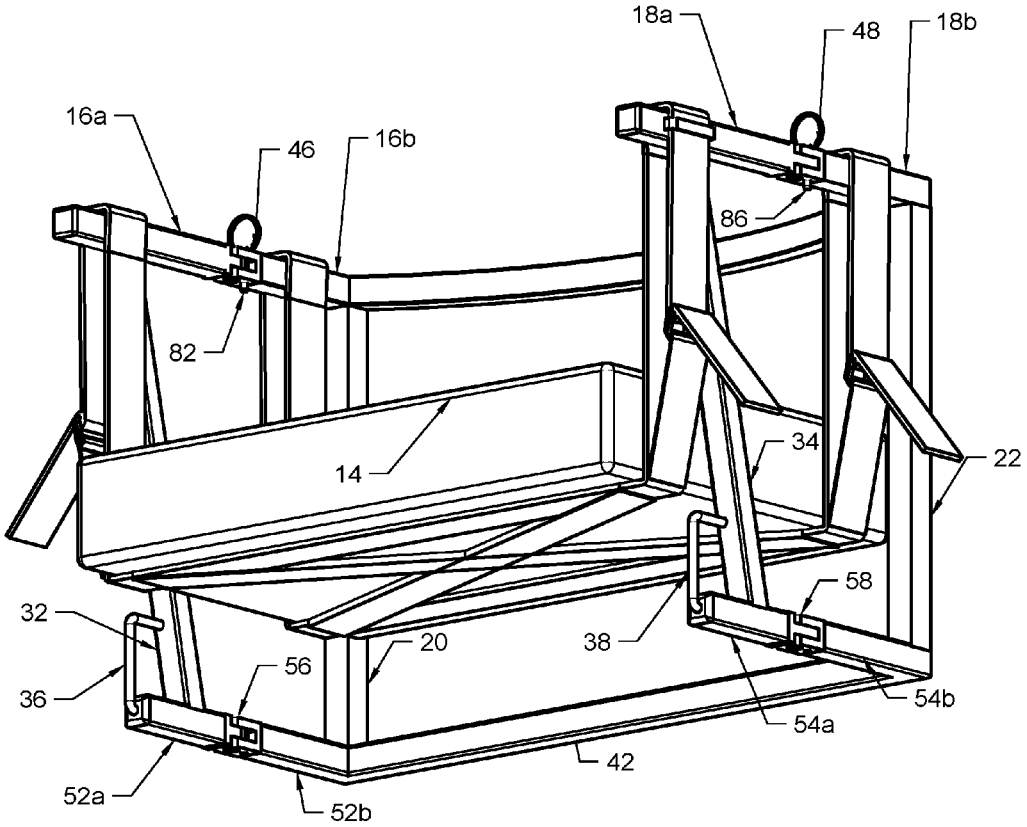
FIG. 7 is a perspective view of an embodiment of a portable seat apparatus in accordance with the present disclosure.

During use, the seat frame 12 is positioned on a surface such as a stadium seat such that first and second base members 52, 54 rest atop the surface. During use, a user sitting in seating device 10 may cause the seating device to have a tendency to tip backward. To address this problem, a first seat hook 36 is positioned on first base member 52, and a second seat hook 38 is positioned on second base member 54. First seat hook 36 includes a first seat hook extension 37 protruding back toward the frame to provide engagement with the underside of the surface on which the seating device 10 is positioned. Similarly, second seat hook 38 includes a second seat hook extension 39 protruding back toward the frame to provide engagement with the underside of the surface on which the seating device 10 is positioned. First and second seat hooks 36, 38 are each pivotable between a deployed position as seen in FIG. 1 and a stowed position as seen in FIG. 7.

During use, seat 14 is generally suspended above the surface on which first and second base members 52, 54 rest. Seat 14 is allowed to swing freely between the first and second arm rests 16, 18 via the straps 24, 26, 28, 30. By providing a seat 14 that is suspended and free to swing between first and second arm rests 16, 18, an enhanced comfort level may be achieved for many users while seated in seat 14.

In some additional embodiments, the height of seat 14 may be adjusted by changing the lengths of the straps 24, 26, 28, 30. For example, in some embodiments, as seen in FIG. 3, first forward strap 24 includes a first forward strap buckle 72 allowing the length of first forward strap 24 between first arm rest 16 and seat 14 to be adjusted up or down. Similarly, first rear strap 26 includes a first rear strap buckle 74 allowing the length of first rear strap 26 between first arm rest 16 and seat 14 to be adjusted up or down. On the other side of the device, as seen in FIG. 1, second forward strap 28 includes a second forward strap buckle 76 allowing the length of second forward strap 28 between second arm rest 18 and seat 14 to be adjusted. Second rear strap 30 also includes a second rear strap buckle 78 allowing the length of second rear strap 30 between second arm rest 18 and seat 14 to be adjusted. Each buckle may include any suitable structure for adjusting the length of its corresponding strap.

Figure 4:
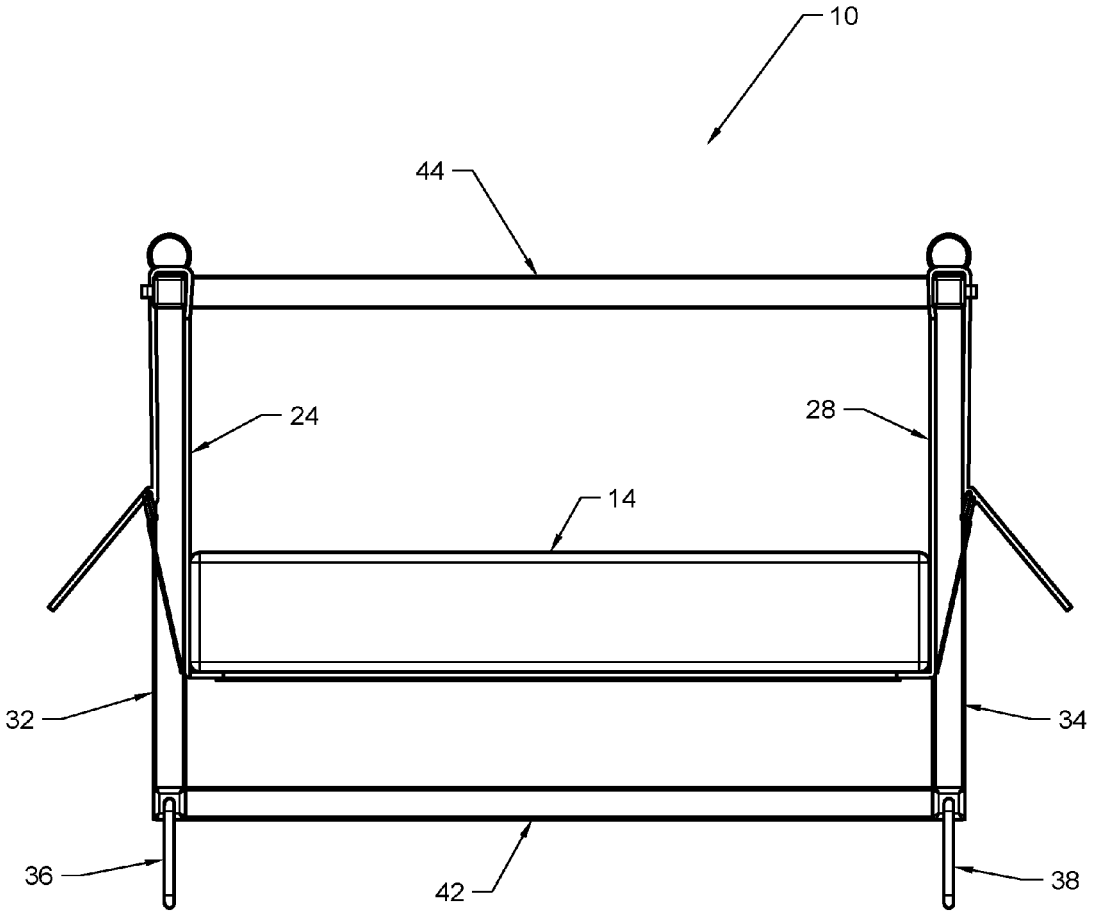
FIG. 4 is a front view of an embodiment of a portable seat apparatus in accordance with the present disclosure.
Figure 5:
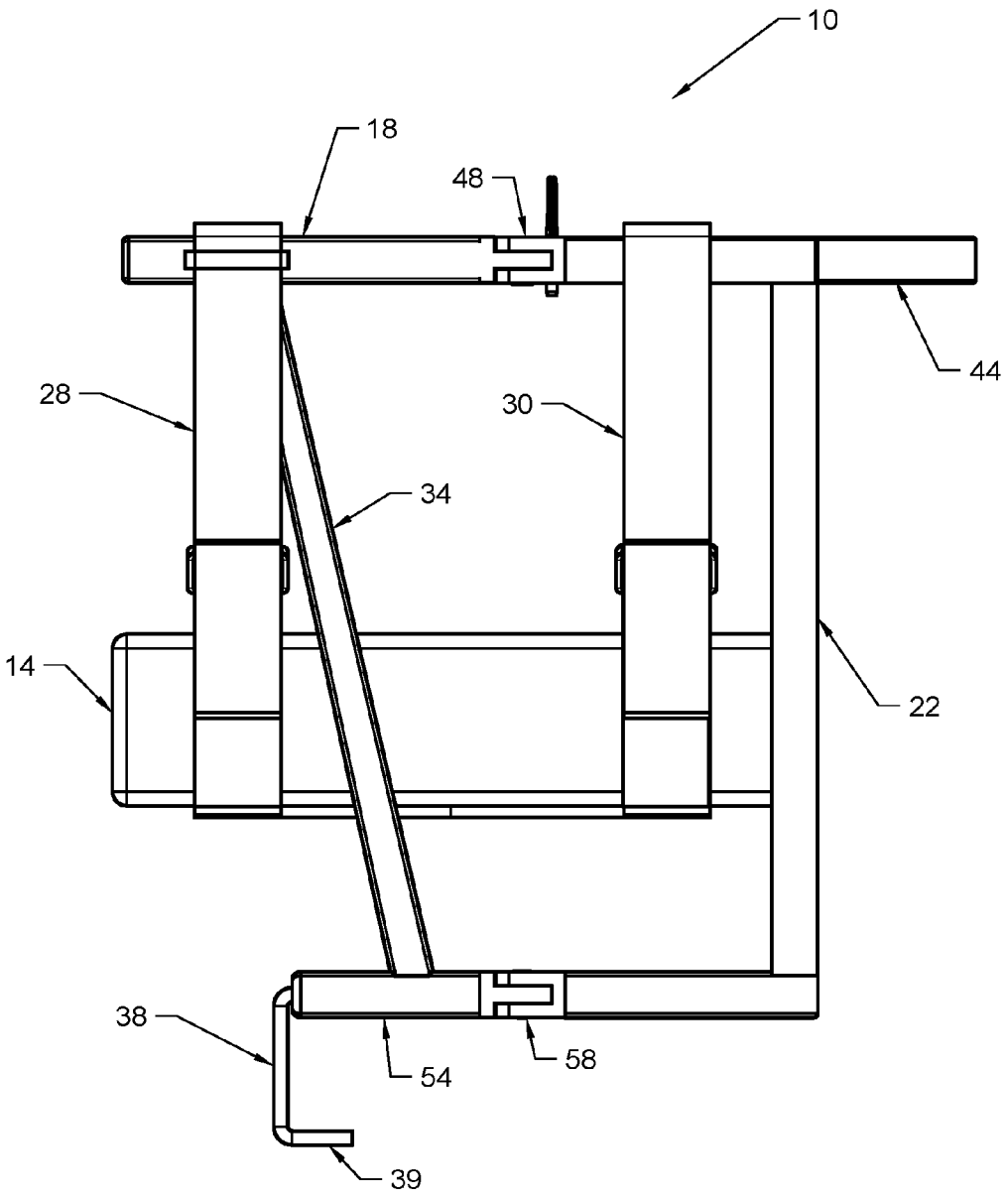
FIG. 5 is a side view of an embodiment of a portable seat apparatus in accordance with the present disclosure.

In some embodiments, all four straps are adjusted to equal lengths as shown in FIG. 4 and FIG. 5. This type of configuration provides a seat 14 that is substantially level in a horizontal plane.

However, in some instances, it may be more comfortable for a user to have seat 14 oriented at an angle. For instance, by adjusting first and second forward straps 24, 28 longer than first and second rear straps 26, 30, seat 14 may be inclined at a forward angle. A user may then be able to sit on seat 14 while positioned at a forward angle to achieve a higher level of comfort. In an opposite configuration, first and second forward straps 24, 28 may be adjusted to be shorter than first and second rear straps 26, 30, causing the seat 14 to be inclined at a rear angle. This type of an inclined seat configuration may be more comfortable for some users.

Figure 6:
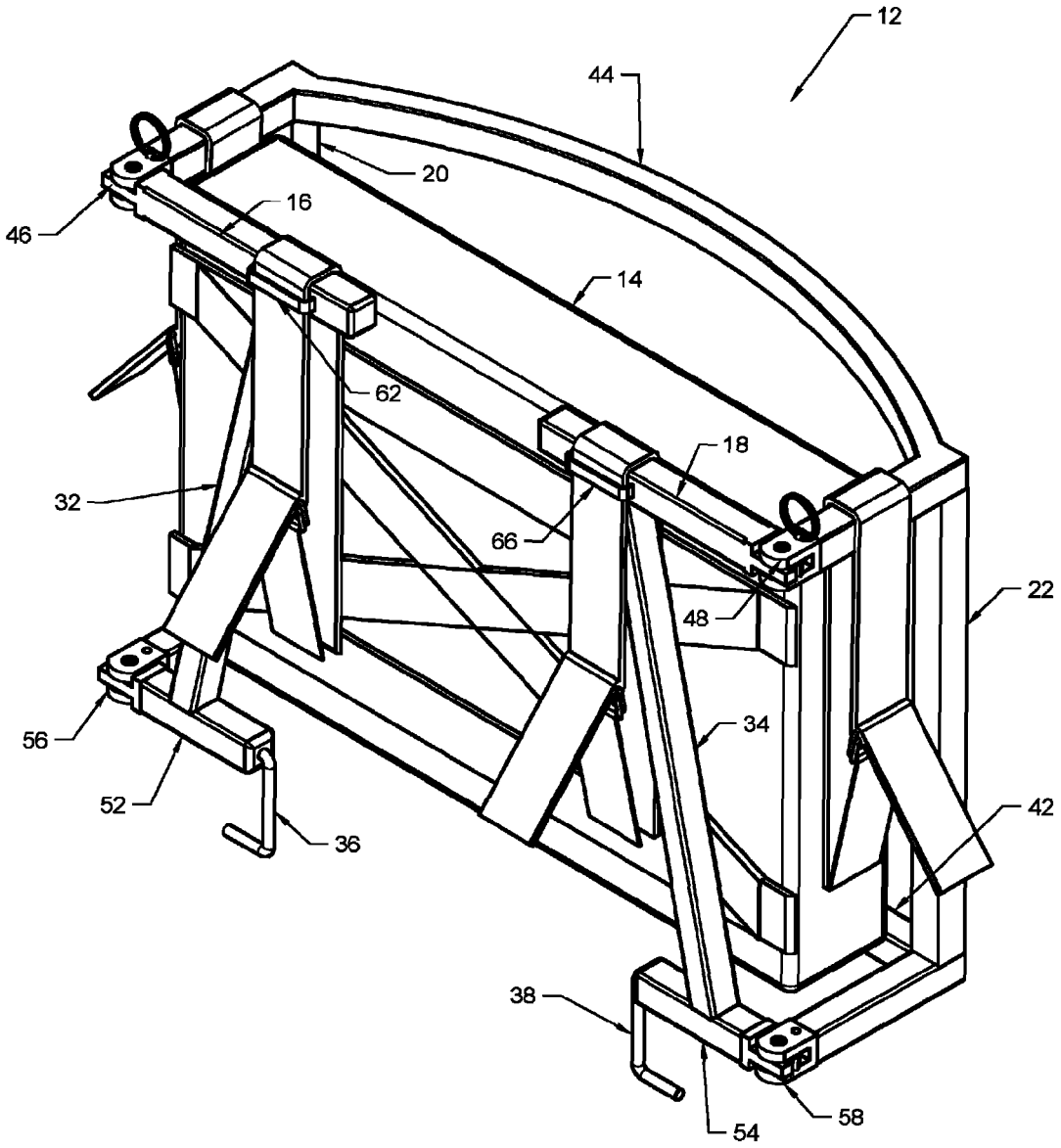
FIG. 6 is a perspective view of an embodiment of a portable seat apparatus in accordance with the present disclosure.

In additional embodiments, the straps may have a tendency to move along the first and second arm rests 16, 18 during use. To retain the straps at desired locations along the length of first and second arm rests, one or more strap retainers may be used. For example, as seen in FIG. 6, a first arm rest forward retainer 62 is positioned on first arm rest 16. First forward strap 24 passes through first arm rest forward retainer 62 and is thereby held in place along the length of first arm rest 16. However, first forward strap 24 may slide vertically through first arm rest forward retainer 62 to adjust the length of first forward strap 24.

Also shown in FIG. 6, a second arm rest forward retainer 66 is positioned on second arm rest 18. Second forward strap 28 passes through second arm rest forward retainer 66 and is thereby held in place along the length of second arm rest 18. However, second forward strap 28 may slide vertically through second arm rest forward retainer 66 to adjust the length of second forward strap 28. Each retainer includes a fixed support, ring, or other suitable structure to provide a guide or retainer for one of the straps. Each retainer may be permanently affixed to the frame or may be moveable along the frame to different desired locations.

Figure 2:
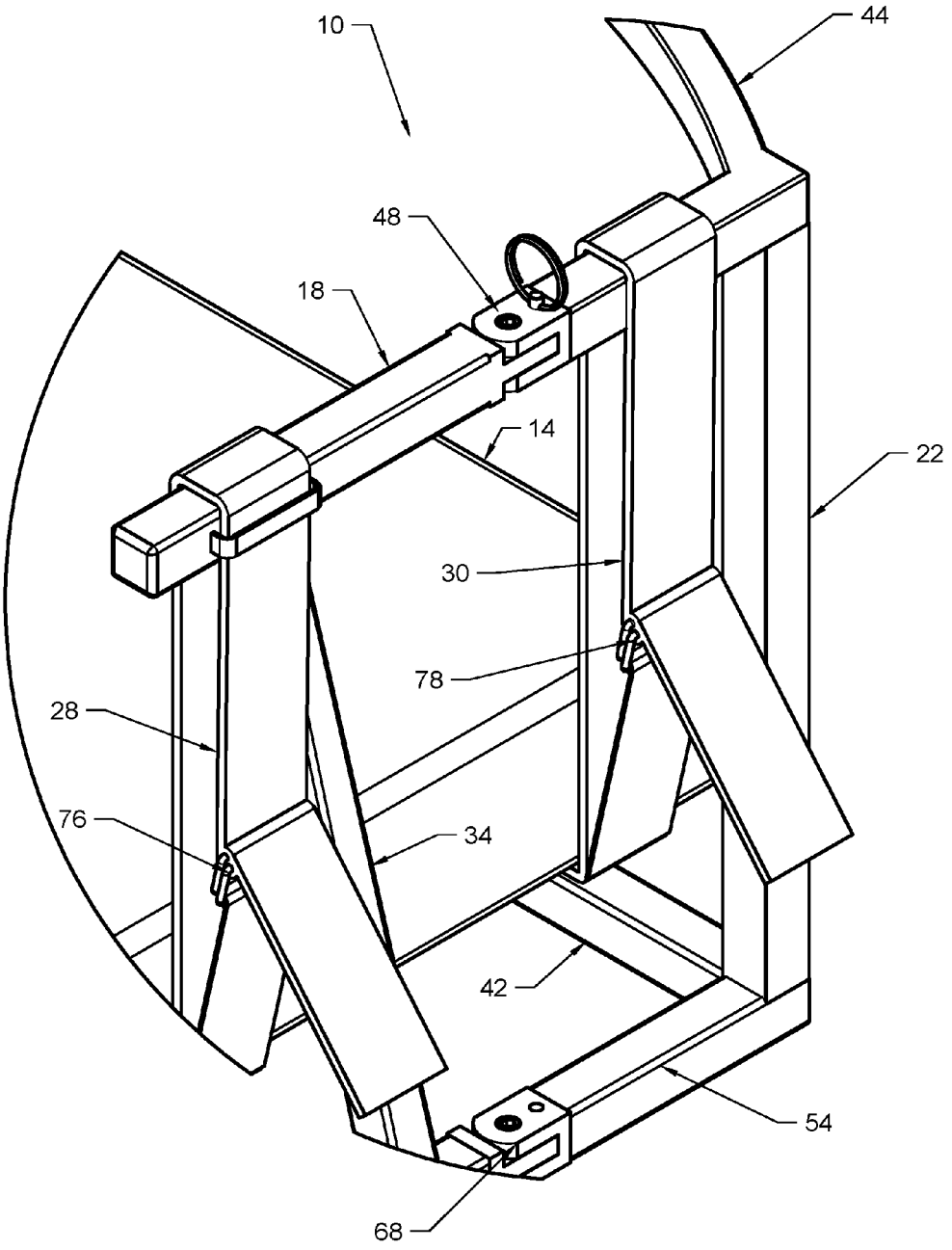
FIG. 2 is a detail perspective view of an embodiment of a portable seat apparatus in accordance with the present disclosure.

Seating apparatus 10 may be difficult to transport to and from events in its fully-assembled state, so in some embodiments seating apparatus 10 is foldable to allow for a more compact form factor for transport. For example, as seen in FIG. 1, seating device 10 is shown in an unfolded, or assembled state. In contrast, as seen in FIG. 6, the frame may be folded to provide a more compact configuration for ease of carry. To achieve a folding configuration, seating apparatus 10 includes one or more hinges in some embodiments. A first arm rest hinge 46 is disposed on first arm rest 16 to allow first arm rest 16 to fold to a more compact position. Similarly, a second arm rest hinge 48 is disposed on second arm rest 18, allowing second arm rest 18 to fold to a more compact position. As shown in the detail view in FIG. 2 of Section 2 from FIG. 1, the second arm rest hinge 48 is positioned at a location along the second arm rest 18 nearer the second rear upright 22 than the second forward upright 34 in some embodiments. Similarly, first arm rest hinge 48 is positioned at a location along the length of first arm rest 16 nearer first rear upright 20 than first forward upright 32. As such, first arm rest 16 and second arm rest 18 may fold inwardly toward seat 14 to reduce the overall form factor of the device.

Additional hinges are located on first and second base members 52, 54 in some embodiments. For example, a first base member hinge 56 is disposed on first base member 52 allowing first base member 52 to fold inwardly to a more compact position. A second base member hinge 58 is disposed on second base member 54, allowing second base member 54 to also fold to a more compact position. In some embodiments, first base member hinge 56 is disposed on first base member 52 directly below first arm rest hinge 46 on first arm rest 16. Similarly, in some embodiments, second base member hinge 58 is positioned on second base member 54 directly below second arm rest hinge 48 on first arm rest 18. As such, first base member 52 and first arm rest 16 may fold toward seat 14 in unison, and second base member 54 and second arm rest 18 may also fold toward seat 14 in unison, as shown in FIG. 6. First base member hinge 56 and first arm rest hinge 46 pivot about a substantially vertical reference axis as shown in FIG. 6 in some embodiments. Second base member hinge 58 and second arm rest hinge 48 also pivot about a separate substantially vertical reference axis as shown in FIG. 6. Additionally, first and second seat hooks 36, 38 may pivot about a substantially horizontal reference axis to allow the seat hooks to be pivoted up into a stowed position for storage or transport.

As seen in FIG. 7, during folding, a first arm rest forward member **16*a* folds about first arm rest hinge 46 relative to first arm rest rear member 16*b* which remains fixed in place on the frame. Similarly, second arm rest forward member 18*a* folds about second arm rest hinge 48 relative to second arm rest rear member 18*b* which remains fixed in place on frame. On the base, first base forward member 52*a* folds about first base member hinge 56 relative to first base rear member 52*b* which remains fixed in place on the frame. Second base forward member 54*a* folds about second base member hinge 58 relative to second base rear member 54***b* which remains fixed in place on frame.

Figure 8:
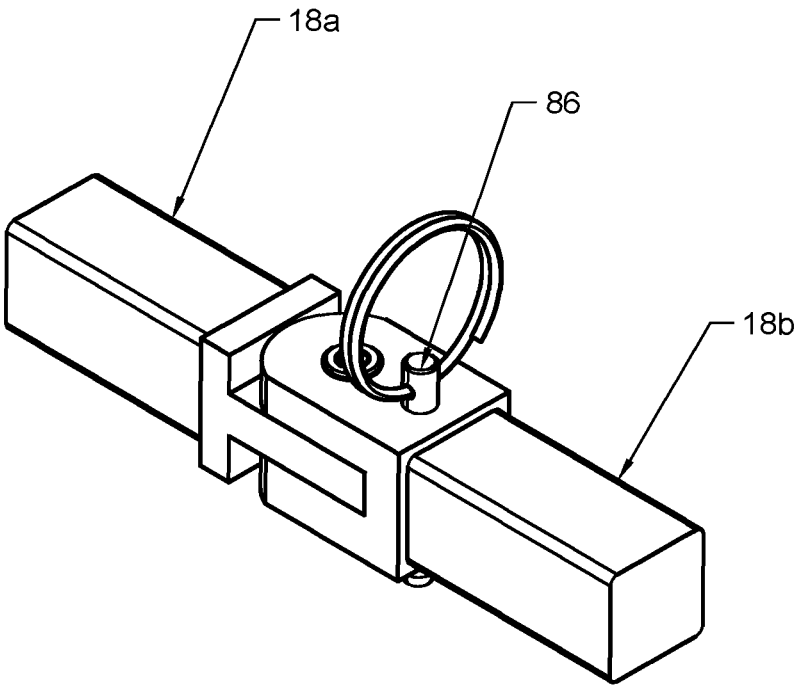
FIG. 8 is a perspective view of a portion of an embodiment of a portable seat apparatus in accordance with the present disclosure.
Figure 9:
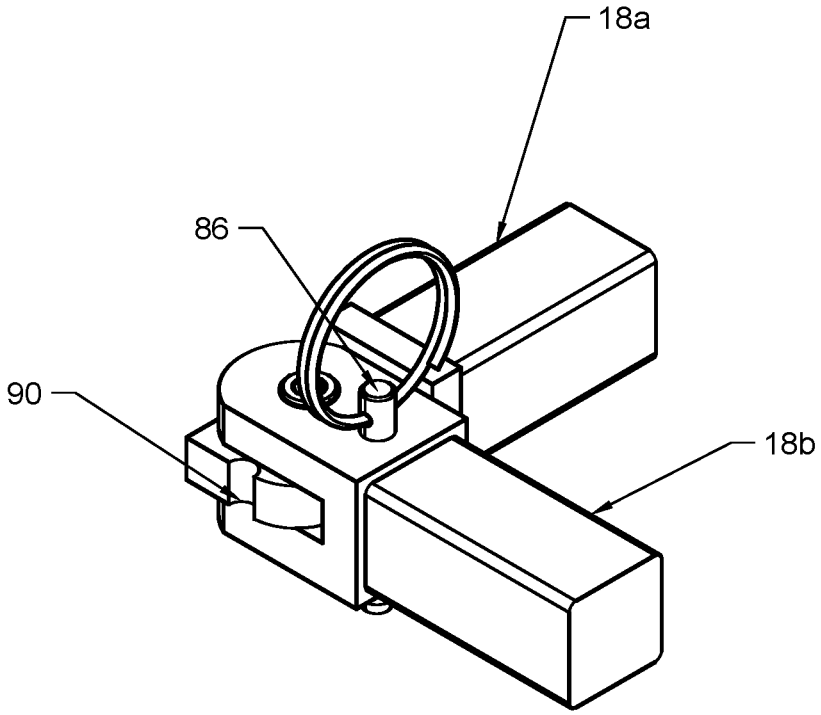
FIG. 9 is a perspective view of a portion of an embodiment of a portable seat apparatus in accordance with the present disclosure.
Figure 10:
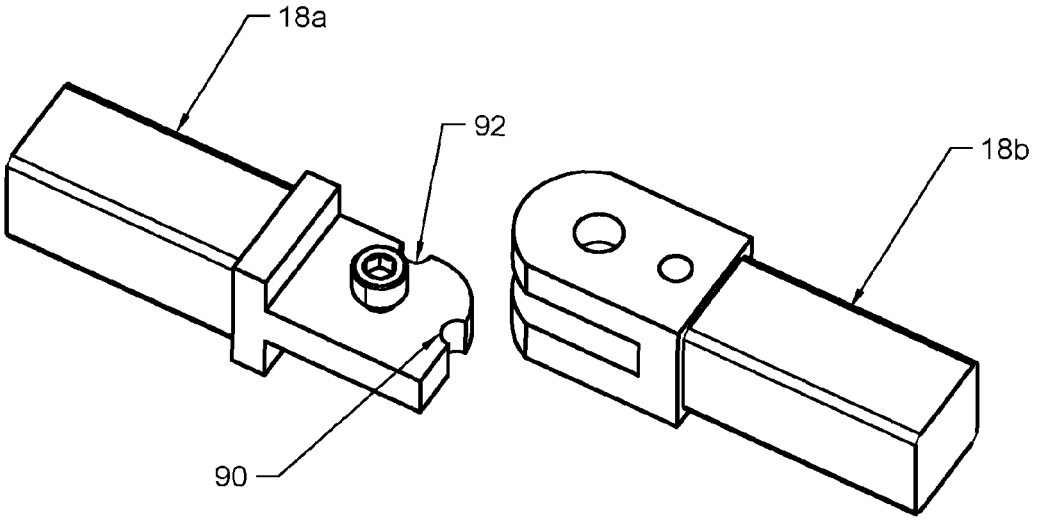
FIG. 10 is a perspective view of a portion of an embodiment of a portable seat apparatus in accordance with the present disclosure.

As shown in FIG. 7, one or more angular locks may be positioned on each hinge to selectively lock the hinge in a folded or unfolded position. For example, a first arm rest hinge lock 82 is positioned on first arm rest hinge 46. A first base member hinge lock may also be positioned on first base member hinge 56 in some embodiments. A second arm rest hinge lock 86 is positioned on second arm rest hinge 48. A second base member hinge lock may also be positioned on second base member hinge 58 in some embodiments. In some embodiments, each hinge lock includes a post extending through a corresponding hole in its respective hinge. For example, as seen in FIG. 8, a second arm rest hinge lock 86 is disposed on the second arm rest hinge. The second arm rest hinge lock 86 includes a vertical post extending downwardly through a corresponding hole in the hinge. A retainer ring is disposed on the post to allow a user to insert or remove the post from the hole. When the hinge lock is in the locked position, the respective member can be locked in an extended position as shown in FIG. 8. Alternatively, as shown in FIG. 9, second arm rest hinge lock 86 can be used to secure the second arm rest 18 in a folded position. In some embodiments, a first recess 90 is defined in each hinge lock to accommodate the post portion of the hinge lock. When the post portion of the hinge lock is received in the first recess on each hinge, the hinge is locked in an extended position as shown in FIG. 8. As seen in FIG. 10, each hinge lock also includes a second recess 92 shaped to accommodate the post portion of the hinge lock. When the post portion of the hinge lock is received in the second recess on each hinge, the hinge is locked in a folded position, as seen in FIG. 9. Various other types of angular locks may be utilized to selectively fix arm rest members and base members in folded and extended positions.

As shown in FIG. 6, when the frame is in a folded position, seat 14 may be rotated upwardly ninety degrees such that it fits between the folded portions of the arm rest and base members and the back of the frame. Seat 14 may be rotated to the upright storage position while one or more straps are still attached to the seat 14 so that a user can easily drop the seat into a sitting position suspended from the straps while unfolding the device.

Thus, although there have been described particular embodiments of the present invention of a new and useful ERGONOMIC STADIUM SEAT, it is not intended that such references be construed as limitations upon the scope of this invention.

What is claimed is:

1. A seating apparatus, comprising:

a first arm rest;

a second arm rest positioned substantially parallel to the first arm rest;

a first base member positioned below the first arm rest;

a second base member positioned below the second arm rest;

a first rear upright member spanning between the first arm rest and the first base member;

a second rear upright member spanning between the second arm rest and the second base member;

a first seat hook disposed on the first base member, wherein the first seat hook is pivotable relative to the first base member;

a first forward strap extending downwardly from the first arm rest;

a second forward strap extending downwardly from the second arm rest;

a first rear strap extending downwardly from the first arm rest;

a second rear strap extending downwardly from the second arm rest; and a seat disposed between the first and second base members, wherein the seat is suspended from the first and second forward straps and the first and second rear straps, and the length of each of the straps is adjustable.

2. The apparatus of claim 1, wherein the first forward strap includes a first forward strap buckle for adjusting the length of the first forward strap.

3. The apparatus of claim 2, wherein the second forward strap includes a second forward strap buckle for adjusting the length of the second forward strap.

4. The apparatus of claim 1, wherein the first rear strap includes a first rear strap buckle for adjusting the length of the first rear strap.

5. The apparatus of claim 4, wherein the second rear strap includes a second rear strap buckle for adjusting the length of the second rear strap.

6. The apparatus of claim 1, further comprising a first arm rest forward retainer positioned on the first arm rest, the first forward strap passing through the first arm rest forward retainer to retain the first forward strap in a first desired location along the length of the first arm rest.

7. The apparatus of claim 6, further comprising a second arm rest forward retainer positioned on the second arm rest, the second forward strap passing through the second arm rest forward retainer to retain the second forward strap in a second desired location along the length of the second arm rest.

8. The apparatus of claim 1, further comprising a second seat hook disposed on the second base member.

9. The apparatus of claim 8, wherein the second seat hook is pivotable relative to the second base member.

10. The apparatus of claim 1, further comprising:

a first arm rest hinge disposed on the first arm rest;

a second arm rest hinge disposed on the second arm rest;

a first base member hinge disposed on the first base member; and a second base member hinge disposed on the second base member.

11. The apparatus of claim 10, further comprising:

a first arm rest lock disposed on the first arm rest hinge;

a second arm rest lock disposed on the second arm rest hinge;

a first base member lock disposed on the first base member hinge; and a second base member lock disposed on the second base member hinge.

12. The apparatus of claim 1, further comprising:

a lower cross member spanning between the first rear upright member and the second rear upright member; and an upper cross member spanning between the first rear upright member and the second rear upright member above the lower cross member.

13. The apparatus of claim 12, wherein the upper cross member includes a concave curve shape.

14. The apparatus of claim 1, wherein the first and second forward straps are adjustable to a length longer than the length of the first and second rear straps to incline the seat at a forward angle.

15. A seating apparatus, comprising:

a first arm rest;

a second arm rest positioned substantially parallel to the first arm rest;

a first base member positioned below the first arm rest;

a second base member positioned below the second arm rest;

a first rear upright member spanning between the first arm rest and the first base member;

a second rear upright member spanning between the second arm rest and the second base member;

a first forward strap extending downwardly from the first arm rest;

a second forward strap extending downwardly from the second arm rest;

a first rear strap extending downwardly from the first arm rest;

a second rear strap extending downwardly from the second arm rest;

a seat disposed between the first and second base members, wherein the seat is suspended from the first and second forward straps and the first and second rear straps, and the length of each of the straps is adjustable;

a first arm rest hinge disposed on the first arm rest;

a second arm rest hinge disposed on the second arm rest;

a first base member hinge disposed on the first base member; and a second base member hinge disposed on the second base member.

16. The apparatus of claim 15, further comprising:

a first arm rest lock disposed on the first arm rest hinge;

a second arm rest lock disposed on the second arm rest hinge;

a first base member lock disposed on the first base member hinge; and a second base member lock disposed on the second base member hinge.

17. The apparatus of claim 15, wherein the first and second forward straps are adjustable to a length longer than the length of the first and second rear straps to incline the seat at a forward angle.

18. A seating apparatus, comprising:

a first arm rest;

a second arm rest positioned substantially parallel to the first arm rest;

a first base member positioned below the first arm rest;

a second base member positioned below the second arm rest;

a first rear upright member spanning between the first arm rest and the first base member;

a second rear upright member spanning between the second arm rest and the second base member;

a lower cross member spanning between the first rear upright member and the second rear upright member;

an upper cross member spanning between the first rear upright member and the second rear upright member above the lower cross member;

a first forward strap extending downwardly from the first arm rest;

a second forward strap extending downwardly from the second arm rest;

a first rear strap extending downwardly from the first arm rest;

a second rear strap extending downwardly from the second arm rest; and a seat disposed between the first and second base members, wherein the seat is suspended from the first and second forward straps and the first and second rear straps, and the length of each of the straps is adjustable.

19. The apparatus of claim 18, wherein the upper cross member includes a concave curve shape.

20. The apparatus of claim 18, wherein the first and second forward straps are adjustable to a length longer than the length of the first and second rear straps to incline the seat at a forward angle.

* * * * *